US008636016B1

(12) United States Patent
Lee

(10) Patent No.: US 8,636,016 B1
(45) Date of Patent: Jan. 28, 2014

(54) COSMETIC GOODS STORAGE DEVICE AND ASSOCIATED USE THEREOF

(76) Inventor: Adrienne Lee, Hanover, PA (US)

( * ) Notice: Subject to any disclaimer, the term of this patent is extended or adjusted under 35 U.S.C. 154(b) by 13 days.

(21) Appl. No.: 12/822,430

(22) Filed: Jun. 24, 2010

Related U.S. Application Data

(60) Provisional application No. 61/219,994, filed on Jun. 24, 2009.

(51) Int. Cl.
*A45D 40/18* (2006.01)
*B65D 71/00* (2006.01)
*B65D 69/00* (2006.01)

(52) U.S. Cl.
USPC ..... 132/286; 206/581

(58) Field of Classification Search
USPC ..... 132/286, 287, 288; 206/581, 823, 6.1, 206/235, 566; D3/901, 903, 295, 296, 291
See application file for complete search history.

(56) References Cited

U.S. PATENT DOCUMENTS

| | | | | |
|---|---|---|---|---|
| 1,650,241 | A * | 11/1927 | Stenholm | 132/288 |
| 3,499,540 | A | 3/1970 | Huncovsky | |
| D303,024 | S | 8/1989 | Zall | |
| D341,715 | S | 11/1993 | Ancona | |
| 5,301,808 | A | 4/1994 | Pierson | |
| 6,401,727 | B1 * | 6/2002 | Carroll | 132/286 |
| D485,682 | S * | 1/2004 | Wolf | D3/295 |
| 7,490,914 | B2 * | 2/2009 | Greiner | 312/321.5 |
| D634,944 | S * | 3/2011 | Walks | D6/440 |
| 2007/0145868 | A1 * | 6/2007 | Greiner | 312/249.2 |
| 2009/0288677 | A1 * | 11/2009 | Chen | 132/315 |

* cited by examiner

*Primary Examiner* — Robyn Doan

(57) ABSTRACT

A cosmetic goods storage device includes a body preferably having a central cavity, a lid and a plurality of doors pivotally connected to the body, a top compartment positioned at a top region of the central cavity, a front compartment positioned subjacent to the top compartment, and a back compartment positioned posterior to the top and front compartments. Each compartment may have at least one of a plurality of pockets, a plurality of drawers and a plurality of trays positioned therein. The back compartment may further include a pencil sharpener and a reservoir removably positioned beneath the pencil sharpener for collecting residual shaving during pencil sharpening procedures. A base may be pivotally coupled to the body such that the body is freely articulated in clockwise and counter clockwise directions.

15 Claims, 5 Drawing Sheets

COSMETIC GOODS STORAGE DEVICE AND ASSOCIATED USE THEREOF

CROSS REFERENCE TO RELATED APPLICATIONS

This application claims the benefit of U.S. Provisional Application No. 61/219,994, filed Jun. 24, 2009, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to cosmetic goods storage devices and, more particularly, to a cosmetic goods storage device for providing users with an efficient and effective means to store and access their cosmetic goods and accessories while allowing a user to apply her make up in an organized manner.

2. Prior Art

Throughout the ages, persons from all walks of life have used cosmetics as a means of enhancing their appearance, maintaining hygiene and improving self-image. In ancient Egypt, women and men alike, bathed in tubs full of milk and honey, adorned their hair with cones of sweet smelling incense and painted their eyes in rich, black kohl. In ancient Rome and Greece, nails were painted specific colors, in order to indicate one's social status and to distinguish the ruling class. In particular, enhancing the lips through the application of color has been practiced in various cultures throughout history. In addition to eye make-up, the ancient Egyptians stained their lips with lush colored henna, while Roman military commanders and warriors painted their lips in vibrant colors before going into battle.

In Japan, the beautiful geisha mixed a paste from crimson sticks of crushed safflower petals in order to paint specific portions of their lips. Once applied, this special paint created an alluring pout and a bold contrast against the geisha's stark, porcelain-painted skin. During the Reformation and Renaissance periods in Europe, women took a less obvious approach to cosmetics. Biting their lips and pinching their cheeks in order to create a rosy, flushed color, women opted for this natural means of altering their appearance, as opposed to the blatant, sacrilege of using cosmetics.

Continuing to decline into the modern era, the fledgling cosmetics industry experienced a devastating blow when Queen Victoria of England denounced lipstick and cosmetics in general, as being suitable only for stage performers and "working" girls. By the 20th century, however, things had drastically changed. Thanks to the roaring 20s wearing cosmetics was back in vogue. In fact, most women adhered to the adage, "the more the better", lining their eyes in rich black, donning false eyelashes and painting their lips to match those of silent screen stars Clara Bow, Mary Pickford and Lillian Gish. From this period on, cosmetics became a mainstay and a must have-item for women everywhere.

Because cosmetics are such an absolute necessity for most female consumers, many women own a small arsenal of supplies such as foundation, blush, eye shadow, eyeliner and lipstick, as well as a variety of applicator wands and brushes, with which to apply these cosmetics. Unfortunately, storing all of these cosmetics can be problematic, especially as most cosmetic bags are sized only to handle a few basic necessities. Not surprisingly, many women find their bathroom or vanity countertops and storage drawers are often cluttered and crowded with cosmetics, not only detracting from the overall appearance of the room, but making finding a particular item extremely difficult.

Accordingly, a need remains for a device in order to overcome the above-noted shortcomings. The present invention satisfies such a need by providing a cosmetic goods storage device that is convenient and easy to use, lightweight yet durable in design, versatile in its applications, and designed for providing a user with an efficient and effective means to store and access their cosmetic goods and accessories.

BRIEF SUMMARY OF THE INVENTION

In view of the foregoing background, it is therefore an object of the present invention to provide a cosmetic goods storage device. These and other objects, features, and advantages of the invention are provided by a cosmetic goods storage device including a body preferably having a central cavity formed along a major interior surface area thereof, a lid and a plurality of doors each pivotally and independently connected to the body respectively, a top compartment statically positioned at a top region of the central cavity. Such top compartment preferably includes a plurality of pockets positioned thereon. A front compartment may be positioned subjacent to the top compartment, wherein the front compartment preferably has a plurality of drawers and a plurality of trays positioned therein.

Also, a back compartment is preferably positioned posterior to the top and front compartments. Such a back compartment preferably includes a plurality of pockets and a pencil sharpener positioned therein. Notably, the back compartment may further include a reservoir removably positioned beneath the pencil sharpener for collecting residual shaving during pencil sharpening procedures. The pencil sharpener and/or the reservoir may be removable from the body during cleaning operations.

In one embodiment, the lid and the doors may be configured in such a manner that the central cavity is isolated from an exterior of the body when the lid and the doors are articulated to closed positions respectively. Additionally, the lid and the doors may be configured in such a manner that the central cavity is open to an exterior of the body when the lid and the doors are articulated to open positions respectively.

In one embodiment, a base may be rotatably coupled to a bottom surface of the body such that the body is freely articulated along clockwise and counter clockwise directions about a centrally registered longitudinal axis.

In one embodiment, a plurality of handles may be attached to the doors and the lid for assisting a user to articulate the lid and the doors between the open and closed positions respectively.

In one embodiment, a mirror is preferably located along a major interior surface of the lid. A light source may be located at the interior surface of the lid and positioned adjacent to a perimeter of the mirror. A user interface may be coupled to the light source. In this manner, a lumen output of the light source may be selectively adjusted via the user interface.

In one embodiment, each of the trays may include a plurality of slots linearly aligned parallel to each other. Such slots receive and separately hold grooming items within the trays.

Also, a plurality of labels affixed to front ends of the trays for identifying the grooming items positioned therein.

The present invention may further include a method of utilizing a cosmetic goods storage device. Such a method preferably includes the chronological steps of: providing a body may have a central cavity formed along a major interior surface area thereof; providing a lid and a plurality of doors; pivotally and independently connecting each of the lid and doors to the body respectively; providing and statically positioning a top compartment at a top region of the central cavity; and providing and positioning a plurality of pockets on the top compartment.

Such a method may further include the chronological steps of: providing and positioning a front compartment subjacent to the top compartment; providing and positioning a plurality of drawers and a plurality of trays in the front compartment; providing and positioning a back compartment posterior to the top and front compartments; providing and positioning a plurality of pockets in the back compartment; providing and positioning a pencil sharpener in the back compartment; providing and removably positioning a reservoir in the back compartment by positioning the reservoir beneath the pencil sharpener for collecting residual shaving; and removing the pencil sharpener from the body during cleaning operations.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
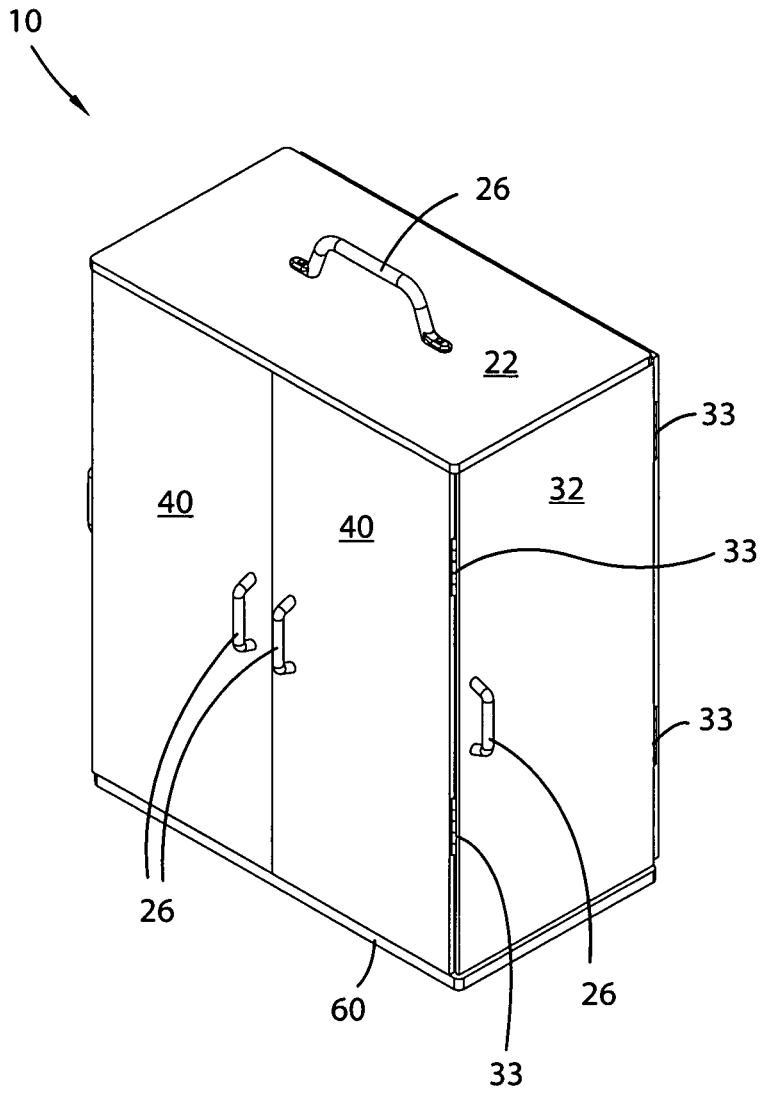
FIG. 1 is a perspective view showing a cosmetic goods storage device at a closed position, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The device 10 of this invention is referred to in FIGS. 1-7 and is intended to provide a cosmetic goods storage device 10. It should be understood that the present invention may be used to store cosmetic goods and many different types of cosmetic accessories such as foundation, blush, eye shadow, eyeliner, lipstick and lip gloss, applicator sponges and cosmetic brushes, and should not be limited to the uses described herein.

Referring initially to FIGS. 1-7, a cosmetic goods storage device 10 includes a body 20 preferably having a central cavity 21 formed along a major interior surface area thereof. Such a body 20 may be made of a heavy duty plastic or polished metal material or other durable material suitable for the intended purpose of storing cosmetic goods. A lid 22 as well as a plurality of doors 30, 32, 40, 50 may be pivotally and independently connected to the body 20. Each door 30, 32, 40, 50 may be opened by hinges 33 and may be secured by clasp fasteners. The combination of such structural elements provides an unpredictable and unexpected benefit of permitting a user to selectively access various sections of body 20 while remaining sections of body 20 remain undisturbed, which solves the problem of needlessly rearranging a location of unselected cosmetic goods when accessing desired cosmetic goods.

Figure 2:
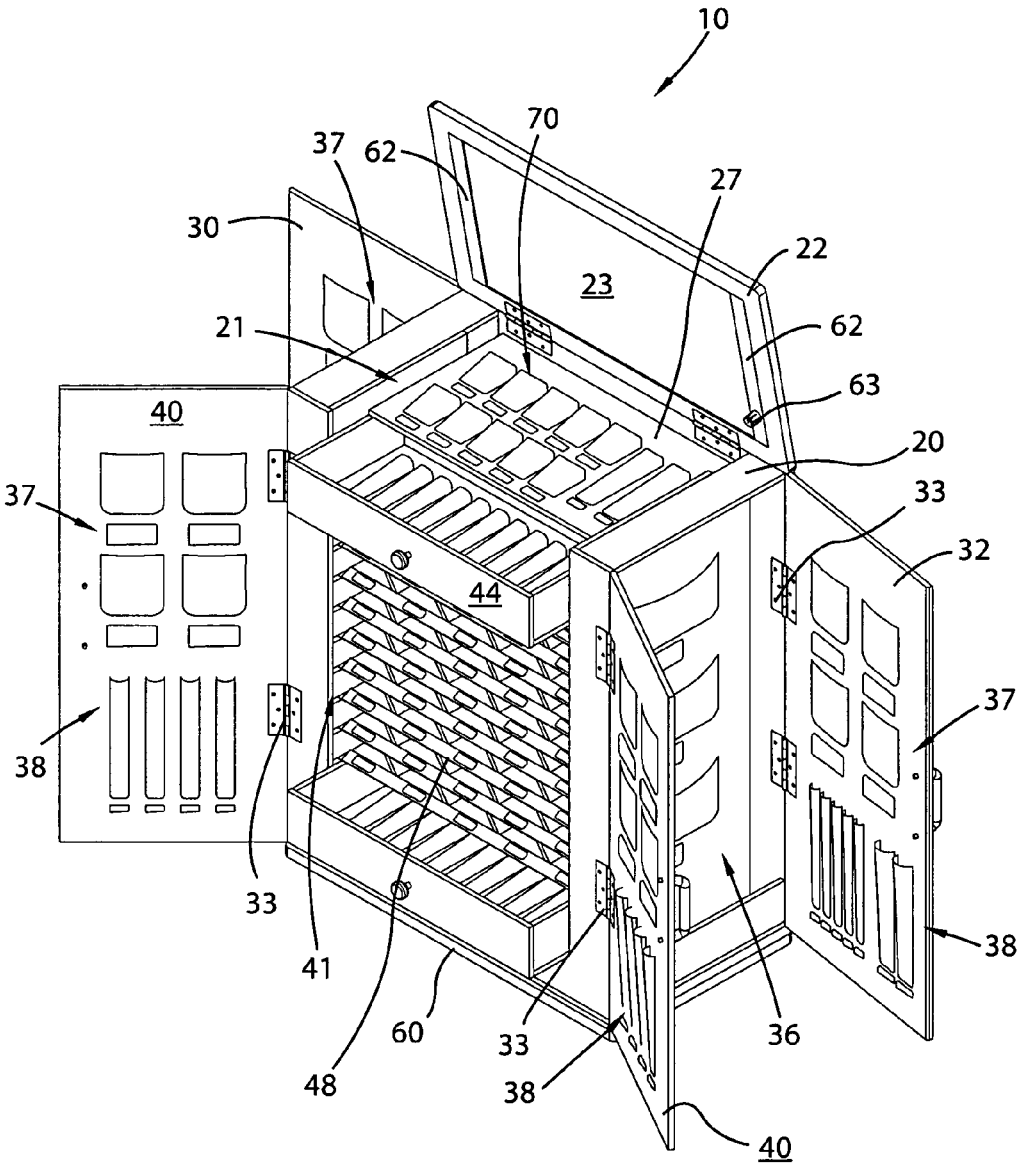
FIG. 2 is a perspective view showing the cosmetic goods storage device at an open position.
Figure 4:
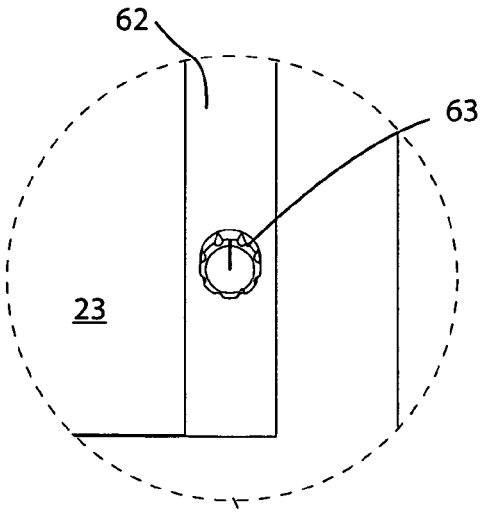
FIG. 4 is an enlarged front elevational view of the user interface (rotary dial)
Figure 5:
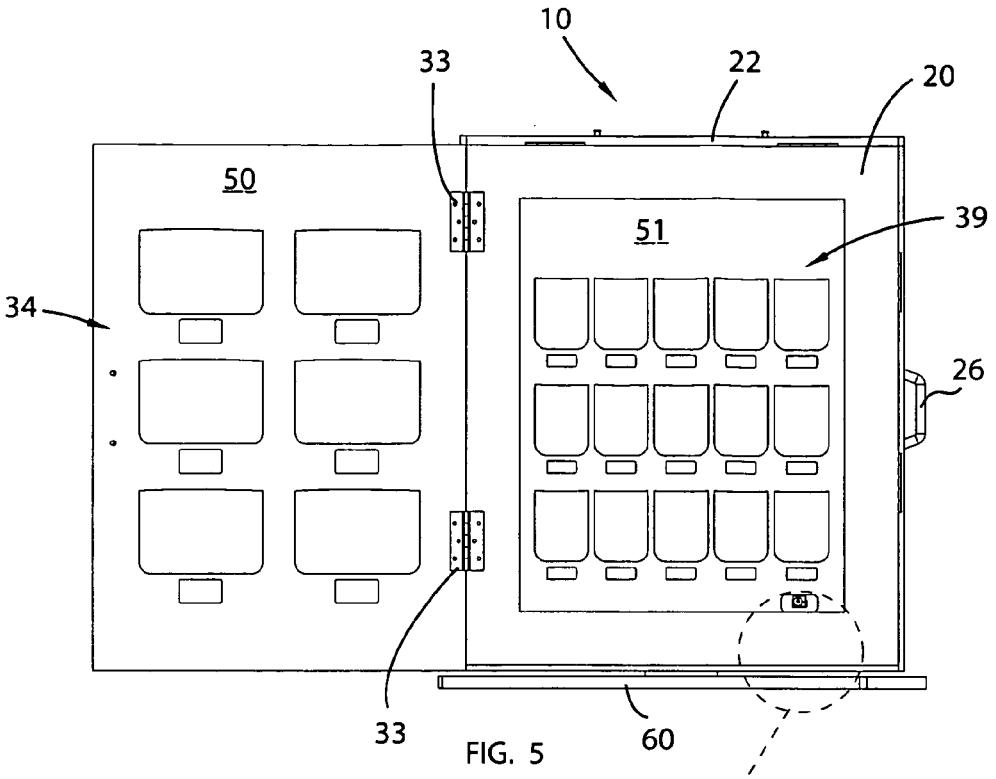
FIG. 5 is a rear elevational view of the storage device showing the pockets on the door and in the back compartment.
Figure 6:
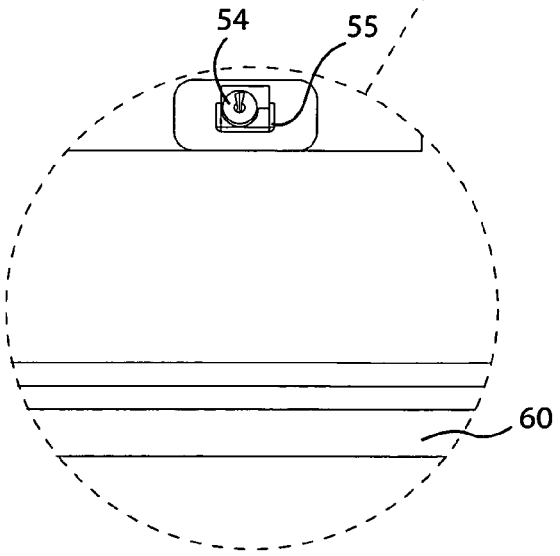
FIG. 6 is an enlarged view of the pencil sharpener and reservoir.
Figure 7:
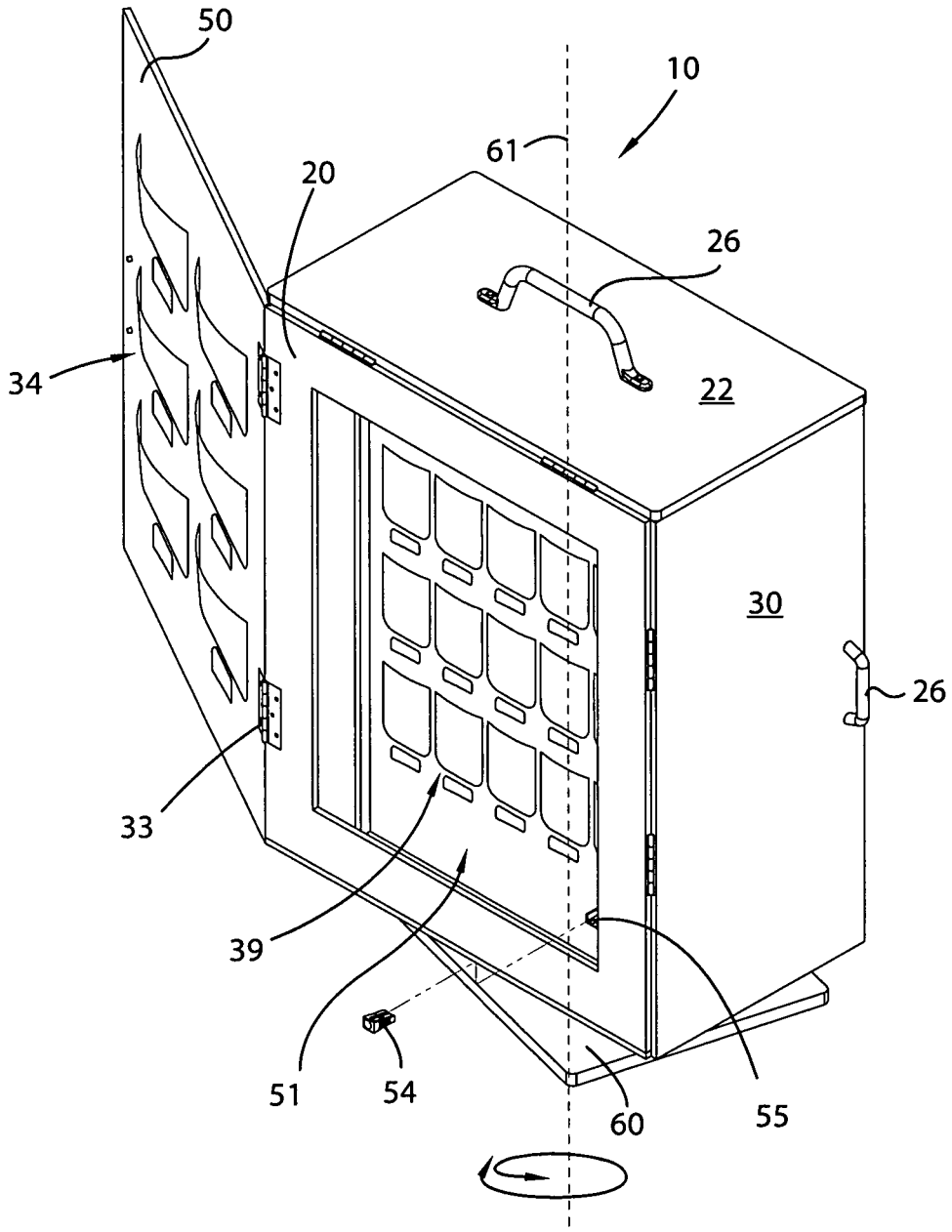
FIG. 7 is a perspective view showing the base rotatably attached to the body and articulated about the longitudinal axis.

Referring to FIGS. 2, 5 and 7, back compartment 51 and door 50 may have tulip shaped pockets 39, 34 on the outer surfaces thereof, respectively. Further, a plurality of pockets 36 may be vertically stacked along a side of body 20 and are hidden from view when side doors 30, 32 are closed, respectively. A series of additional pockets 38 are vertically aligned in parallel to each other along a bottom section of doors 30, 32, 40, also shown in FIG. 3. The combination of such structural elements provides an unpredictable and unexpected benefit of separately storing cosmetic goods at opposite sides of body 20 and thereby maintaining a center of mass proximate to axis 61, which solves the problem of premature and undesirable tipping of body 20 when cosmetic items are selectively accessed.

Referring to FIG. 2, a top compartment 27 may be statically positioned at a top region of the central cavity 21. Such top compartment 27 preferably includes a plurality of pockets 70 positioned thereon. A front compartment 41 may be positioned subjacent to the top compartment 27, wherein the front compartment 41 preferably has a plurality of drawers 44, 46 and a plurality of trays 48 positioned therein.

Referring back to FIGS. 5-7, a back compartment 51 is preferably positioned posterior to top and front compartments 27, 41. Such a back compartment 51 preferably includes a plurality of pockets 39 and a pencil sharpener 54 positioned therein. Notably, the back compartment 51 may further include a reservoir 55 removably positioned beneath the pencil sharpener 54 for collecting residual shaving during pencil sharpening procedures. The pencil sharpener 54 and/or the reservoir 55 may be removable from the body 20 during cleaning operations. A hand-held brush may also be included to sweep the pencils shavings from space-confined areas in the back compartment 51. The combination of such structural elements provides an unpredictable and unexpected benefit of permitting a user to discretely sharpen the pencil-style cosmetic goods without creating undesirable waste along front compartment 41, which solves the problem of having to repeatedly clean trays 38 and drawers 44, 46 when exposed to pencil shavings.

In one embodiment, each compartment 27, 41, 51 may be lined with VELVET, micro-fiber, SATEEN and/or NYLON materials, for supporting the cosmetic goods.

Referring to FIGS. 1 and 2, lid 22 and doors 30, 32, 40, 50 may be configured in such a manner that central cavity 21 is isolated from an exterior of body 20 when lid 22 and doors 30, 32, 40, 50 are articulated to closed positions, respectively. Additionally, lid 22 and doors 30, 32, 40, 50 may be configured in such a manner that central cavity 21 is open to an exterior of body 20 when lid 22 and doors 30, 32, 40, 50 are articulated to open positions, respectively. The combination of such structural elements provides an unpredictable and unexpected benefit of permitting simultaneous access to each compartment 27, 41, 51 while also prohibiting any unauthorized access to compartments 27, 41, 51.

In one embodiment, as perhaps best shown in FIG. 7, a base 60 may be rotatably coupled to a bottom surface of body 20 such that body 20 is freely articulated along clockwise and counter clockwise directions about a centrally registered longitudinal axis 61.

In one embodiment, a plurality of handles 26 may be attached to the doors 30, 32, 40, 50 and the lid 22 for assisting a user to articulate the lid 22 and the doors 30, 32, 40, 50 between the open and closed positions, respectively.

Figure 3:
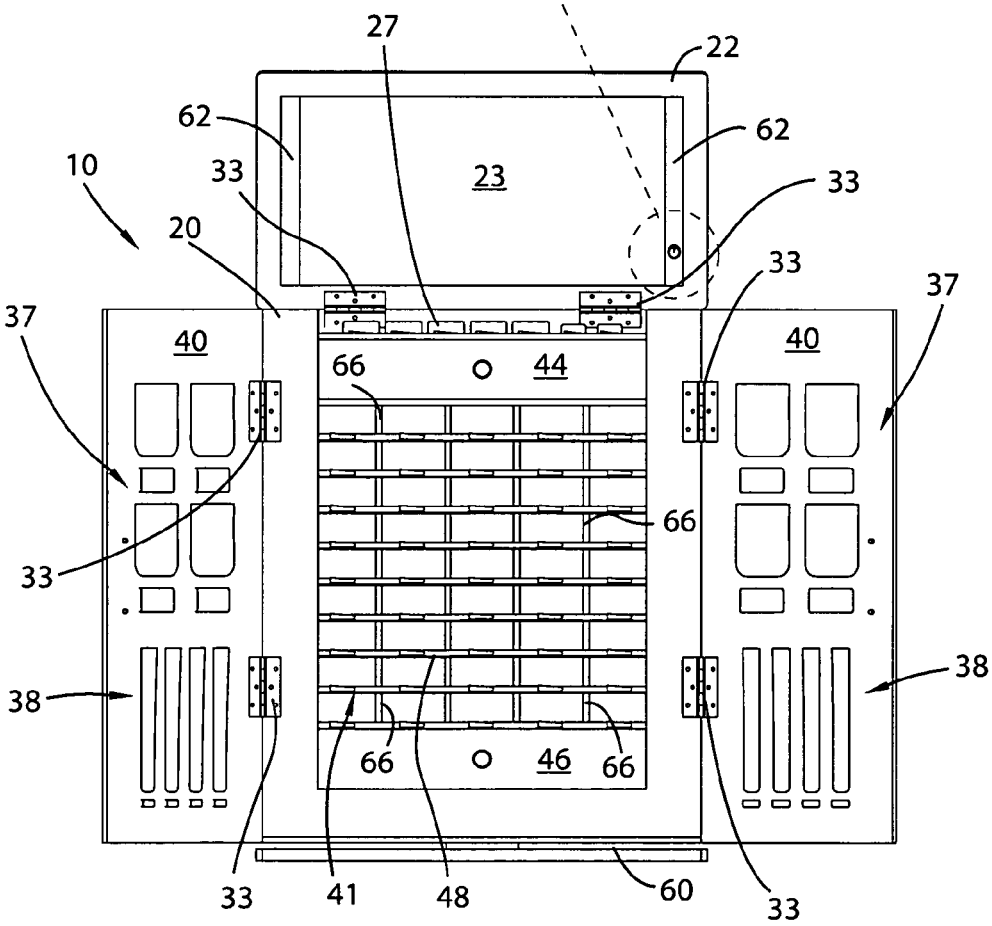
FIG. 3 is a front elevational view showing the various pockets, trays and drawers.

Referring to FIGS. 2 and 3, a mirror 23 is preferably located along a major interior surface of the lid 22. A light source 62 may be located at the interior surface of the lid 22 and positioned adjacent to a perimeter of the mirror 23. A user interface 63 may be electrically coupled to the light source 62, in a conventional manner. The light source 62 may be illuminated by a conventional internal power source (such as a rechargeable battery), in a manner well known in the art. In this manner, a lumen output of light source 62 may be selectively adjusted via the user interface 63. The mirror may be concave/convex and thereby provides a greater/lesser magnified reflection of at least 2-times the size of an image.

As perhaps best shown in FIGS. 2 and 3, each tray 48 may include a plurality of slots 66 linearly aligned parallel to each other. Such slots 66 receive and separately hold grooming items within trays 48. Also, a plurality of labels 64 may be affixed to front ends of trays 48 for identifying the grooming items positioned therein.

The present invention may further include a method of utilizing a cosmetic goods storage device 10. Such a method preferably includes the chronological steps of: providing a body 20 having a central cavity 21 formed along a major interior surface area thereof; providing a lid 22 and a plurality of doors 30, 32, 40, 50; pivotally and independently connecting each lid 22 and doors 30, 32, 40, 50 to body 20 respectively; providing and statically positioning a top compartment 27 at a top region of the central cavity 21; and providing and positioning a plurality of pockets 70 on top compartment 27.

Such a method may further include the chronological steps of: providing and positioning a front compartment 41 subjacent to the top compartment 27; providing and positioning a plurality of drawers 44, 46 and a plurality of trays 48 in the front compartment 41; providing and positioning a back compartment 51 posterior to the top and front compartments 27, 41; providing and positioning a plurality of pockets 39 in the back compartment 51; providing and positioning a pencil sharpener 54 in the back compartment 51; providing and removably positioning a reservoir 55 in the back compartment 51 by positioning the reservoir 55 beneath the pencil sharpener 54 for collecting residual shaving; and removing pencil sharpener 54 and/or reservoir 55 from the body 20 during cleaning operations.

As an example, the cosmetic goods storage device 10 would be simple and straightforward to use. First, the user would store the storage device 10 on their bathroom countertop, vanity, dressing table or other easily accessed location. The user would then load the individual storage compartments with various cosmetic items and accessories. In order to access these goods, the user would lift the unit lid 22 and/or open doors 30, 32, 40, 50, revealing the various drawers, trays and pockets. The user could then utilize the mirror 23 found on the underside of the lid 22 to apply their cosmetics. After use, the user would place their cosmetics back into the appropriate compartment 27, 41, 51, storing the unit away until again needed.

In an alternative embodiment, the device 10 may feature LEDs in various compartments 27, 41, 51 to enable the user to see in dimly lit environments. In another alternative embodiment, the device 10 may feature wheels to allow the user to pull the device 10 closer to them if it is very heavy.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A cosmetic goods storage device comprising:

a body having a single and unitary central cavity formed therein;

a lid and a plurality of doors each being pivotally connected to said body respectively;

a top compartment positioned at a top region of said central cavity, said top compartment including a plurality of pockets positioned thereon;

a front compartment positioned subjacent to said top compartment, said front compartment having a plurality of drawers and a plurality of trays positioned therein; and a back compartment including a plurality of pockets and a pencil sharpener positioned therein, said back compartment further including a reservoir removably positioned beneath said pencil sharpener for collecting residual shavings;

wherein said single and unitary central cavity spans from a front pair of said doors to a rear one of said doors;

wherein said single and unitary central cavity spans from a left one of said doors to a right one of said doors;

wherein said body has first, second, third and fourth corners oppositely located at outer edges of said body respectively, said front pair of doors being pivotal about said first and second corners, said right and left doors being pivotal about said third and fourth corners respectively, said rear door being pivotal about said fourth corner.

2. The cosmetic goods storage device of claim 1, wherein said lid and said doors are configured in such a manner that said central cavity is isolated from an exterior of said body when said lid and said doors are articulated to closed positions respectively.

3. The cosmetic goods storage device of claim 2, wherein said lid and said doors are configured in such a manner that said central cavity is open to an exterior of said body when said lid and said doors are articulated to open positions respectively.

4. The cosmetic goods storage device of claim 1, further comprising: a base rotatably coupled to a bottom surface of said body such that said body is freely articulated along clockwise and counter clockwise directions about a centrally registered longitudinal axis.

5. The cosmetic goods storage device of claim 1, further comprising: a plurality of handles attached to said doors and said lid for assisting a user to articulate said lid and said doors between the open and closed positions respectively.

6. The cosmetic goods storage device of claim 1, further comprising:

a mirror located along a major interior surface of said lid;

a light source located at said interior surface of said lid and positioned adjacent to a perimeter of said mirror; and a user interface coupled to said light source;

wherein a lumen output of said light source is selectively adjusted via said user interface.

7. The cosmetic goods storage device of claim 1, wherein each of said trays comprises:

a plurality of slots linearly aligned parallel to each other, said slots adapted to receive and separately hold grooming items within said trays; and a plurality of labels affixed to front ends of said trays for identifying the grooming items positioned therein.

8. A cosmetic goods storage device comprising:

a body having a single and unitary central cavity formed along a major interior surface area thereof;

a lid and a plurality of doors each being pivotally and independently connected to said body respectively;

a top compartment statically positioned at a top region of said central cavity, said top compartment including a plurality of pockets positioned thereon a front compartment positioned subjacent to said top compartment, said front compartment having a plurality of drawers and a plurality of trays positioned therein; and a back compartment positioned posterior to said top and front compartments, said back compartment including a plurality of pockets and a pencil sharpener positioned therein, said back compartment further including a reservoir removably positioned beneath said pencil sharpener for collecting residual shavings, said pencil sharpener being removable from said body during cleaning operations;

wherein said single and unitary central cavity spans from a front pair of said doors to a rear one of said doors;

wherein said single and unitary central cavity spans from a left one of said doors to a right one of said doors;

wherein said body has first, second, third and fourth corners oppositely located at outer edges of said body respectively, said front pair of doors being pivotal about said first and second corners, said right and left doors being pivotal about said third and fourth corners respectively, said rear door being pivotal about said fourth corner.

9. The cosmetic goods storage device of claim 8, wherein said lid and said doors are configured in such a manner that said central cavity is isolated from an exterior of said body when said lid and said doors are articulated to closed positions respectively.

10. The cosmetic goods storage device of claim 9, wherein said lid and said doors are configured in such a manner that said central cavity is open to an exterior of said body when said lid and said doors are articulated to open positions respectively.

11. The cosmetic goods storage device of claim 10, further comprising: a base rotatably coupled to a bottom surface of said body such that said body is freely articulated along clockwise and counter clockwise directions about a centrally registered longitudinal axis.

12. The cosmetic goods storage device of claim 11, further comprising: a plurality of handles attached to said doors and said lid for assisting a user to articulate said lid and said doors between the open and closed positions respectively.

13. The cosmetic goods storage device of claim 12, further comprising:

a mirror located along a major interior surface of said lid;

a light source located at said interior surface of said lid and positioned adjacent to a perimeter of said mirror; and a user interface coupled to said light source;

wherein a lumen output of said light source is selectively adjusted via said user interface.

14. The cosmetic goods storage device of claim 13, wherein each of said trays comprises:

a plurality of slots linearly aligned parallel to each other, said slots adapted to receive and separately hold grooming items within said trays; and a plurality of labels affixed to front ends of said trays for identifying the grooming items positioned therein.

15. A method of assembling a cosmetic goods storage device, said method comprising the chronological steps of:

providing a body having a central cavity formed along a major interior surface area thereof;

providing a lid and a plurality of doors;

pivotally and independently connecting each of said lid and doors to said body respectively;

providing and statically positioning a top compartment at a top region of said central cavity;

providing and positioning a plurality of pockets on said top compartment;

providing and positioning a front compartment subjacent to said top compartment;

providing and positioning a plurality of drawers and a plurality of trays in said front compartment;

providing and positioning a back compartment posterior to said top and front compartments;

providing and positioning a plurality of pockets in said back compartment;

providing and positioning a pencil sharpener in said back compartment;

providing and removably positioning a reservoir in said back compartment by positioning said reservoir beneath said pencil sharpener for collecting residual shavings; and removing said pencil sharpener from said body during cleaning operations;

wherein said single and unitary central cavity spans from a front pair of said doors to a rear one of said doors;

wherein said single and unitary central cavity spans from a left one of said doors to a right one of said doors;

wherein said body has first, second, third and fourth corners oppositely located at outer edges of said body respectively, said front pair of doors being pivotal about said first and second corners, said right and left doors being pivotal about said third and fourth corners respectively, said rear door being pivotal about said fourth corner.

* * * * *